US012650276B1

(12) United States Patent
Hillis et al.

(10) Patent No.: US 12,650,276 B1
(45) Date of Patent: Jun. 9, 2026

(54) LOCK FOR A FIREARM

(71) Applicant: Go Safe Technology, Inc., Stamford, CT (US)

(72) Inventors: Mark Hillis, Stamford, CT (US); Grant Gregory, Stamford, CT (US)

(73) Assignee: Go Safe Technology, Inc., Stamford, CT (US)

( * ) Notice: Subject to any disclaimer, the term of this patent is extended or adjusted under 35 U.S.C. 154(b) by 0 days.

(21) Appl. No.: 19/207,987

(22) Filed: May 14, 2025

Related U.S. Application Data

(60) Provisional application No. 63/729,313, filed on Dec. 6, 2024.

(51) Int. Cl.
*F41A 17/44* (2006.01)
*F41A 17/32* (2006.01)

(52) U.S. Cl.
CPC ..... *F41A 17/44* (2013.01); *F41A 17/32* (2013.01)

(58) Field of Classification Search
CPC ..... F41A 17/44; F41A 17/32; F41A 17/34; F41A 17/38
See application file for complete search history.

(56) References Cited

U.S. PATENT DOCUMENTS 1,355,067 A 10/1920 Rydberg
1,484,671 A 2/1924 Pomeroy
3,857,325 A 12/1974 Thomas
4,384,420 A * 5/1983 Von Muller ..... F41A 17/02 42/70.11
4,528,765 A * 7/1985 Johnson ..... F41A 17/44 42/70.11
4,532,729 A * 8/1985 Von Muller ..... F41A 17/02 42/70.11
4,619,062 A * 10/1986 Johnson ..... F41A 17/44 42/70.11
4,709,496 A * 12/1987 Johnson ..... F41A 17/44 42/70.11
5,052,138 A 10/1991 Crain
5,113,603 A 5/1992 Buegel
5,379,541 A 1/1995 Bammate
(Continued)

FOREIGN PATENT DOCUMENTS

WO 9855817 12/1998
WO 2010039111 4/2010

*Primary Examiner* — Joshua E Freeman
(74) *Attorney, Agent, or Firm* — Bennet K. Langlotz; Langlotz Patent & Trademark Works, LLC

(57) ABSTRACT

Locks for a firearm have a lock body configured to be closely and removably received in the magazine well, the lock body having an upper portion configured to extend into the bolt passage when installed in the firearm, with the upper portion interposed between the reciprocating bolt and the forward extending barrel, a locking mechanism at a lower portion of the lock body and having a locked condition and an unlocked condition, and a latch element connected at the upper portion of the lock body and interfacing the locking mechanism to move between an unlocked position when the locking mechanism is in the unlocked condition and a locked position when the locking mechanism is in the locked condition. The latch element may protrude from the lock body when in the locked position. The latch element may protrude in a forward direction from the lock body when in the locked position.

18 Claims, 5 Drawing Sheets

(56) References Cited

U.S. PATENT DOCUMENTS 5,628,134 A 5/1997 Wesp et al.
5,636,464 A 6/1997 Ciluffo
5,782,029 A 7/1998 Brooks
5,826,360 A 10/1998 Herold et al.
5,946,840 A 9/1999 Mickel
5,974,717 A 11/1999 Brooks
5,987,796 A * 11/1999 Brooks ..... F41A 17/38 42/70.11
6,237,271 B1 5/2001 Kaminski
6,253,479 B1 7/2001 Fuchs et al.
6,256,919 B1 * 7/2001 Brazeau ..... F41A 17/44 42/70.11
6,286,241 B1 9/2001 Constant et al.
6,286,242 B1 9/2001 Klebes
6,308,450 B1 * 10/2001 Ireblad ..... F41A 17/44 42/70.11
6,321,478 B1 11/2001 Klebes
6,351,906 B1 3/2002 Honig, Jr. et al.
6,357,156 B1 3/2002 Klebes et al.
6,357,157 B1 3/2002 Constant et al.
6,412,207 B1 7/2002 Crye et al.
6,442,880 B1 9/2002 Allan
6,457,271 B1 10/2002 Vaid et al.
6,499,244 B1 * 12/2002 Smith ..... F41A 17/44 42/70.11
6,519,887 B1 2/2003 Allen et al.
6,631,579 B1 10/2003 Lauster et al.
6,655,066 B2 12/2003 Fluhr
7,222,450 B2 5/2007 Cuprin et al.
7,240,449 B2 7/2007 Clifton, Jr.
7,543,403 B1 * 6/2009 Schaefer ..... F41A 17/02 42/70.11
7,568,302 B1 8/2009 Bubits
7,568,392 B1 8/2009 Koike et al.
7,581,345 B2 9/2009 McGarry
8,205,372 B2 6/2012 Anzeloni
8,215,048 B2 7/2012 Summers
8,740,026 B2 6/2014 Osborne et al.
8,887,431 B2 11/2014 Horanoff
9,057,571 B2 6/2015 Kemmerer et al.
9,341,425 B2 5/2016 Carlson
9,354,011 B2 5/2016 Cooke et al.
10,018,438 B2 7/2018 Biran
10,260,831 B2 4/2019 Biran et al.
10,422,601 B2 9/2019 Harris
10,753,691 B1 8/2020 Williams et al.
10,914,542 B2 2/2021 Biran et al.
10,914,543 B2 2/2021 Dulude et al.
11,906,258 B1 * 2/2024 Woodard ..... F41A 17/38
11,971,232 B1 * 4/2024 Woodard ..... F41A 17/44
12,050,071 B2 * 7/2024 Brusseau ..... F41A 17/063
12,055,355 B2 8/2024 Dulude et al.
12,292,248 B1 * 5/2025 Tanaka ..... F41A 17/44
2002/0069570 A1 6/2002 Lee
2002/0162265 A1 11/2002 Abad
2004/0111945 A1 6/2004 Glock
2004/0211103 A1 10/2004 Aske
2005/0246933 A1 11/2005 McGarry
2006/0080881 A1 4/2006 Cuprin et al.
2008/0120888 A1 5/2008 Matyko et al.
2011/0252682 A1 10/2011 Delgado Acarreta
2012/0085010 A1 4/2012 Cook
2012/0174453 A1 7/2012 Kallio
2013/0019510 A1 1/2013 Kemmerer et al.
2014/0305018 A1 10/2014 Horanoff
2015/0290775 A1 * 10/2015 Bennett ..... B25B 11/00 269/287
2015/0377574 A1 12/2015 Cooke et al.
2016/0054081 A1 2/2016 Creed
2016/0069627 A1 3/2016 Cobb
2016/0169608 A1 6/2016 Schulz et al.
2016/0172876 A1 6/2016 Stewart et al.
2016/0252317 A1 9/2016 Biran et al.
2016/0290750 A1 10/2016 McCormick
2017/0146309 A1 * 5/2017 Biran ..... F41A 17/38
2017/0146310 A1 * 5/2017 Biran ..... F41A 17/066
2018/0023911 A1 * 1/2018 Harris ..... F41A 17/44 42/70.02
2018/0066910 A1 * 3/2018 Biran ..... F41A 17/46
2018/0372436 A1 * 12/2018 Biran ..... F41A 17/38
2019/0025000 A1 1/2019 Bascom
2020/0400398 A1 * 12/2020 Dulude ..... F41A 17/34

* cited by examiner

LOCK FOR A FIREARM

CROSS-REFERENCE TO RELATED APPLICATION

This application claims the benefit of U.S. Provisional Patent Application No. 63/729,313 filed on Dec. 6, 2024, entitled "Locking Device for Firearms," which is hereby incorporated by reference in its entirety for all that is taught and disclosed therein.

FIELD OF THE INVENTION

The present invention relates to firearms, and more particularly to a lock for a firearm that enables a firearm to be reliably secured from unauthorized use regardless of the firearm's location.

BACKGROUND AND SUMMARY OF THE INVENTION

Firearms are typically secured from unauthorized use with gun safes, lock boxes, external trigger locks, or cable locks. Gun safes and lock boxes have limited uses and are typically stationary in the home. Trigger locks and cable locks have limited effectiveness and can be relatively easy to defeat to allow unauthorized use of the firearm.

Therefore, a need exists for a new and improved lock for a firearm that enables a firearm to be reliably secured from unauthorized use regardless of the firearm's location. In this regard, the various embodiments of the present invention substantially fulfill at least some of these needs. In this respect, the lock for a firearm according to the present invention substantially departs from the conventional concepts and designs of the prior art, and in doing so provides an apparatus primarily developed for the purpose of enabling a firearm to be reliably secured from unauthorized use regardless of the firearm's location.

The present invention provides an improved lock for a firearm, and overcomes the above-mentioned disadvantages and drawbacks of the prior art. As such, the general purpose of the present invention, which will be described subsequently in greater detail, is to provide an improved lock for a firearm that has all the advantages of the prior art mentioned above.

To attain this, the preferred embodiment of the present invention essentially comprises a lock body configured to be closely and removably received in the magazine well, the lock body having an upper portion configured to extend into the bolt passage when installed in the firearm, with the upper portion interposed between the reciprocating bolt and the forward extending barrel, a locking mechanism at a lower portion of the lock body and having a locked condition and an unlocked condition, and a latch element connected at the upper portion of the lock body and interfacing the locking mechanism to move between an unlocked position when the locking mechanism is in the unlocked condition and a locked position when the locking mechanism is in the locked condition. The latch element may protrude from the lock body when in the locked position. The latch element may protrude in a forward direction from the lock body when in the locked position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
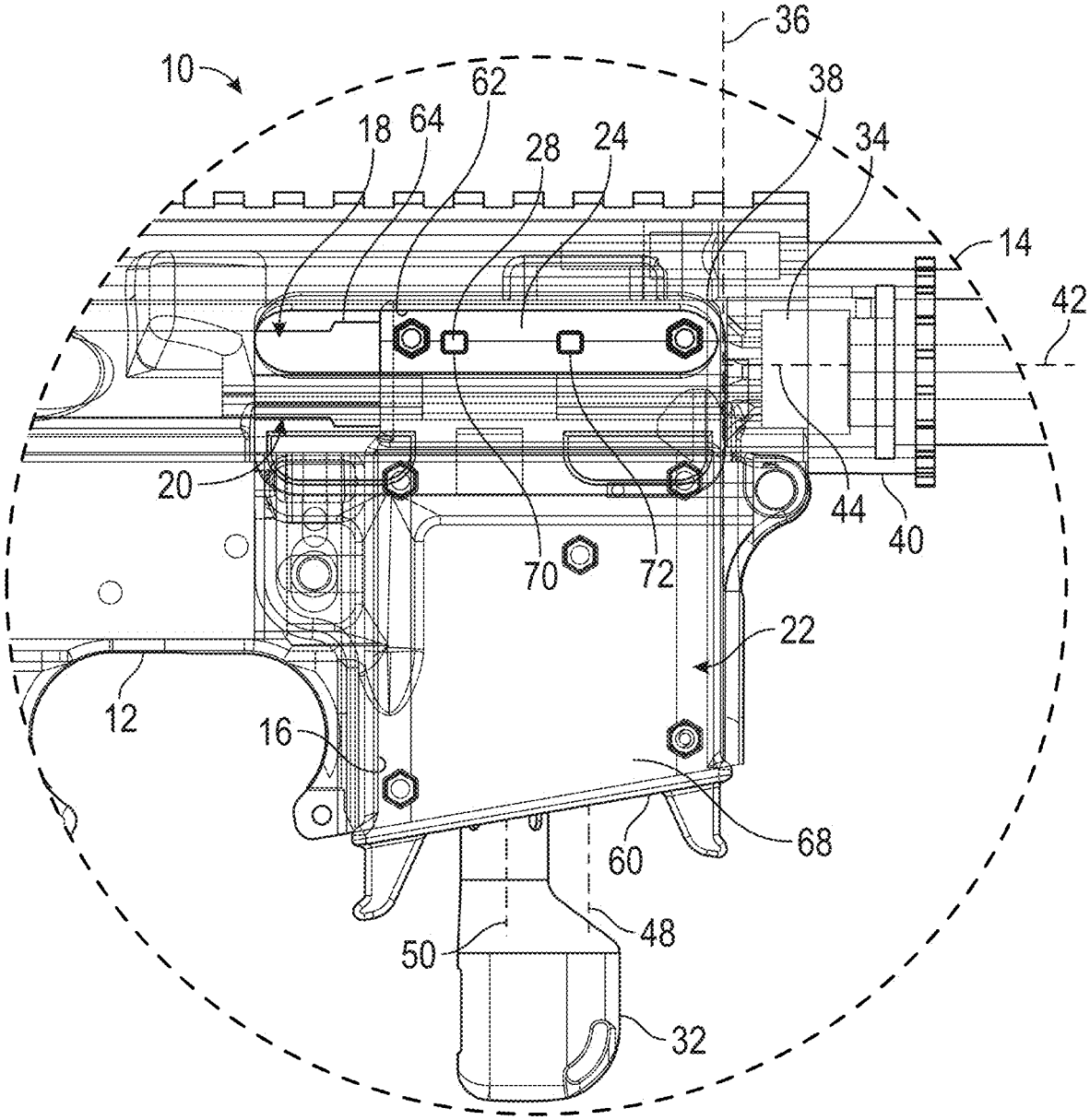
FIG. 1A is a right side view of the current embodiment of a lock for a firearm constructed in accordance with the principles of the present invention in use installed in a rifle in the unlocked condition.

An embodiment of the lock for a firearm of the present invention is shown and generally designated by the reference numeral 10.

Figure 1B:
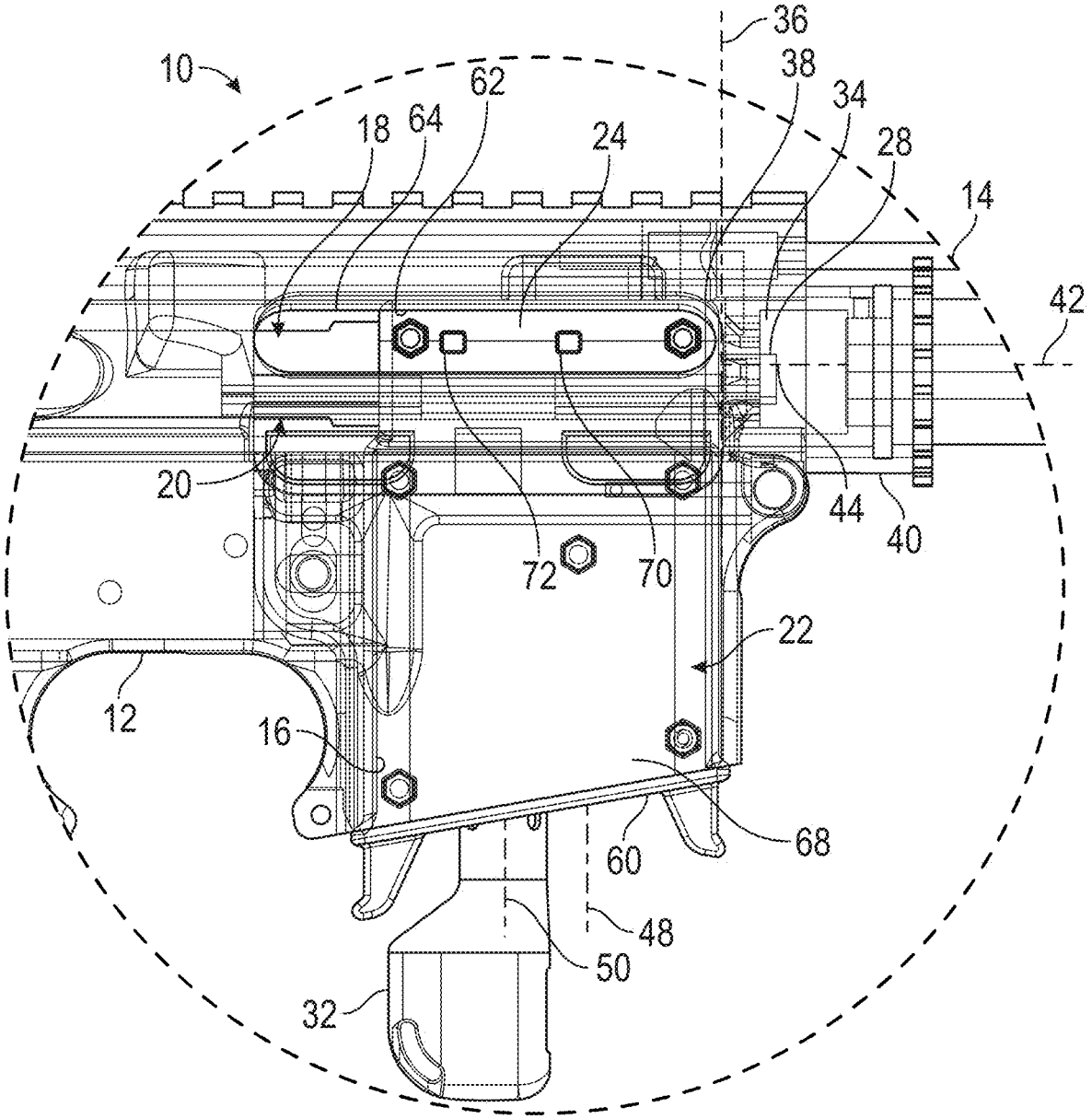
FIG. 1B is a right side view of the lock for a firearm of FIG. 1A in use installed in a rifle in the locked condition.
Figure 2:
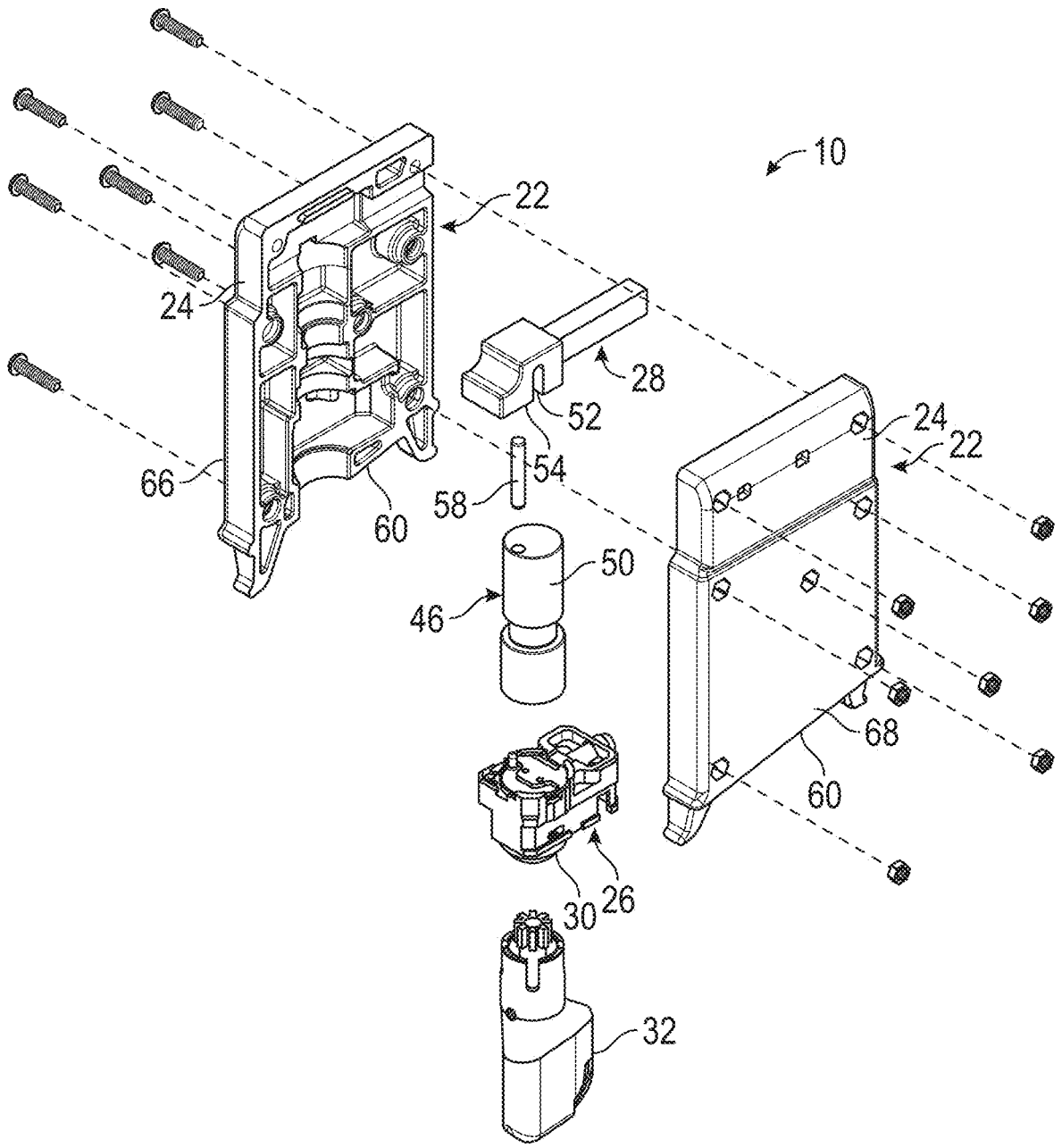
FIG. 2 is an exploded view of the lock for a firearm of FIG. 1A.
Figure 3:
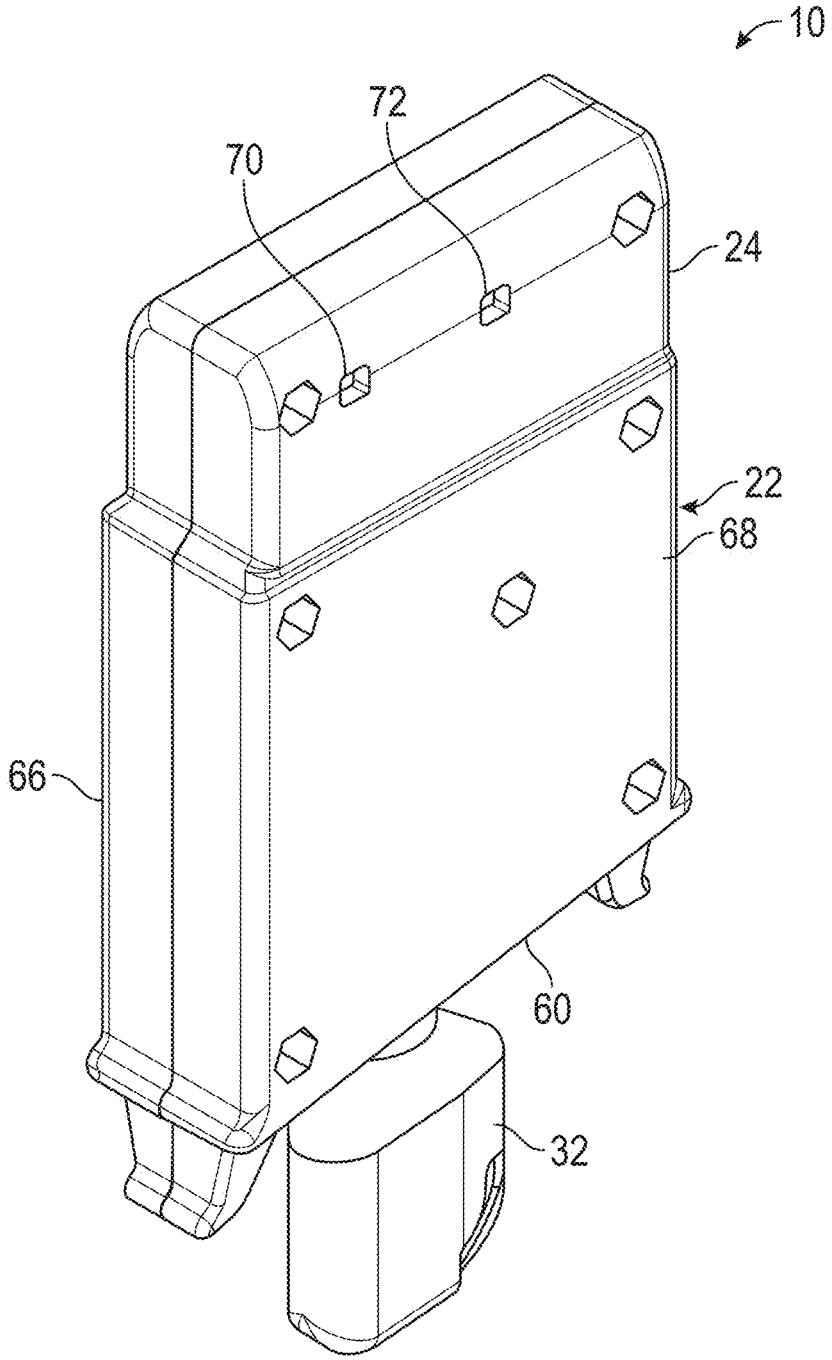
FIG. 3 is a top isometric enlarged view of the lock for a firearm of FIG. 1 in the unlocked condition.
Figure 4:
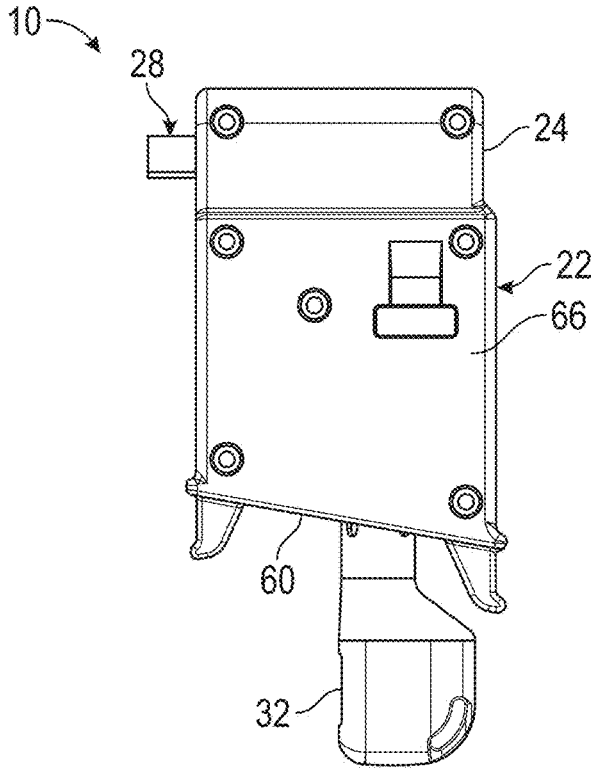
FIG. 4 is a left side view of the lock for a firearm of FIG. 1 in the locked condition.
Figure 5:
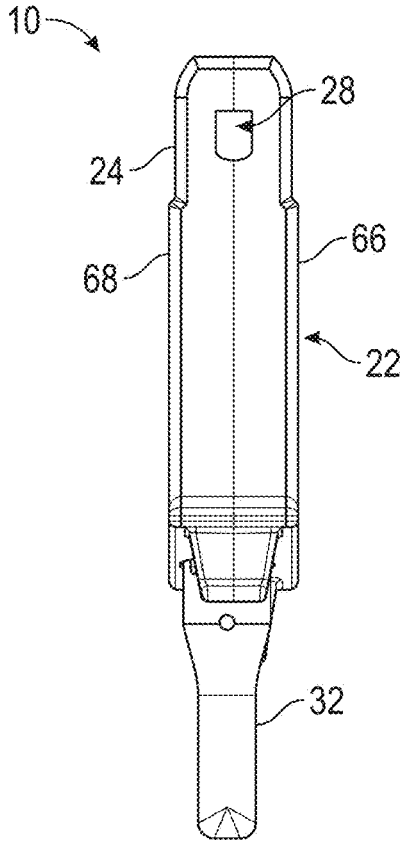
FIG. 5 is a front view of the lock for a firearm of FIG. 1 in the locked condition.

FIG. 1 illustrates the improved lock for a firearm 10 of the present invention. More particularly, the lock for a firearm 10 reliably secures a firearm having a frame 12 with a forward extending barrel 14 and defining a magazine well 16 and a bolt passage 18 containing a reciprocating bolt 20 movable between a rearward retracted position and a forward battery position from unauthorized use regardless of the firearm's location. The lock for a firearm 10 has a lock body 22 configured to be closely and removably received in the magazine well. The lock body has an upper portion 24 configured to extend into the bolt passage when installed in the magazine well of the firearm, with the upper portion interposed between the reciprocating bolt and the forward extending barrel. Thus, the lock body locks the reciprocating bolt 20 in the rearward retracted position when the lock body is installed in the magazine well of the firearm.

The lock body has a locking mechanism 26 at a lower portion of the lock body. The locking mechanism has a locked condition and an unlocked condition. A latch element 28 is connected at the upper portion of the lock body and interfaces with the locking mechanism to move between an unlocked position when the locking mechanism is in the unlocked condition and a locked position when the locking mechanism is in the locked condition. The locking mechanism includes a key insertion receptacle 30 at a lower face 60 of the lock body. A detachable key 32 is inserted into the key insertion receptacle and rotated to move the locking mechanism between the locked condition and the unlocked condition. When the detachable key has been turned to move the locking mechanism into the locked condition while the lock body is received in magazine well, the latch element has moved into the locked position and blocks the bolt head receptacle to further prevent any use or loading of the host firearm while the lock body is received in magazine well and the locking mechanism 26 is in the locked condition. The lock body additionally prevents the loading or use of the host firearm by obstructing the magazine well to prevent the insertion of a magazine (not shown), while also preventing disassembly of the firearm.

In the current embodiment, the latch element 28 protrudes from the lock body 22 when in the locked position to prevent removal of the lock body from the magazine well 16. More particularly, the latch element protrudes in a forward direction from the lock body when in the locked position. The latch element extends beyond a forward limit 36 of the magazine well when in the locked position. The latch element extends forward of a rear portion 38 of the forward extending barrel 14 when in the locked position. The latch element extends into an opening defined by the forward extending barrel when in the locked position. The opening defined by the forward extending barrel is the bolt head receptacle 34. The opening defined by the forward extending barrel is defined at least in part by a barrel extension 40.

In the current embodiment, the forward extending barrel 14 defines a barrel axis 42. The upper portion 24 of the lock body 22 extends above the barrel axis. The upper portion of the lock body extends proximate to an upper surface portion 62 of the bolt passage 18. The upper portion of the lock body extends above an upper portion 64 of the reciprocating bolt. The latch element 28 reciprocates along a latch axis 44 parallel to the barrel axis 42. The latch element reciprocates without rotation. The locking mechanism 26 and the latch element are operably connected by a rotating element, which is a shaft 46. The magazine well 16 defines a magazine insertion axis 48, and the shaft is aligned for rotation on a shaft rotation axis 50 parallel to the magazine insertion axis. The latch element includes a yoke 52 defining a transverse surface 54, and the locking mechanism includes a rotor 56 having an offset pin 58 engaging the transverse surface. Thus, the locking mechanism and latch element are interconnected by a scotch yoke.

The lock body 22 includes a left half 66 and a right half 68. The right half defines a rear aperture 70 and a forward aperture 72. The rear aperture is located such that the latch element 28 is visible through the rear aperture when the locking mechanism is in the unlocked condition. The forward aperture is located such that the latch element is visible through the forward aperture when the locking mechanism is in the locked condition. The latch element is preferably a contrasting color from the lock body, such as red, to make the status of the locking mechanism readily apparent when viewed through the ejection port 74 defined by the frame 12.

In the current embodiment, the lock body 22 and latch element 28 are sized to fit an AR-style rifle magazine well 16. The upper portion 24 is partially curved to conform to the top of the cylindrical bolt passage 18. The lock body is 0.88 inch wide, and the latch element protrudes 0.38 inch from the lock body when the locking mechanism 26 is in the locked condition. It should be appreciated that even if a round is chambered in the forward extending barrel 14, the lock for a firearm 10 can still be installed in the magazine well and be placed in the locked condition to prevent discharge of the host firearm. This is accomplished because the lock body locks the bolt 20 in the rearward position, which prevents engagement of the bolt face with the chamber and the firing pin from striking the chambered round.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a lock for a firearm has been described in detail, it should be apparent that modifications and variations thereto are possible, all of which fall within the true spirit and scope of the invention. The lock for a firearm is suitable for use with pistols, rifles, light and medium machine guns, and other firearms having a magazine well. In the case of a pistol, a bolt can be a slide, and a "bolt path" can include a pistol's space forward of the breech face during the slide's reciprocation, because the breech faces acts on a cartridge to chamber it and retain chamber pressure upon discharge just as a rifle's reciprocating bolt does. A lock made on these principles for a pistol would have the benefit of requiring the slide to be retracted to admit the lock, providing visual verification, and preventing discharge even if a round were left in the chamber. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lock for a firearm having a frame with a forward extending barrel and defining a magazine well and a bolt passage containing a reciprocating bolt movable between a rearward retracted position and a forward battery position, the lock for a firearm comprising:

a lock body configured to be closely and removably received in the magazine well;

the lock body having an upper portion configured to extend into the bolt passage when installed in the firearm, with the upper portion interposed between the reciprocating bolt and the forward extending barrel;

a locking mechanism at a lower portion of the lock body and having a locked condition and an unlocked condition;

a latch element connected at the upper portion of the lock body and interfacing the locking mechanism to move between an unlocked position when the locking mechanism is in the unlocked condition and a locked position when the locking mechanism is in the locked condition; and wherein the latch element protrudes from the lock body when in the locked position.

2. The lock for a firearm of claim 1 wherein the latch element extends forward of a rear portion of the forward extending barrel when in the locked position.

3. The lock for a firearm of claim 1 wherein the latch element extends into an opening defined by the forward extending barrel when in the locked position.

4. The lock for a firearm of claim 3 wherein the opening defined by the forward extending barrel is a bolt head receptacle.

5. The lock for a firearm of claim 3 wherein the opening defined by the forward extending barrel is defined at least in part by a barrel extension.

6. The lock for a firearm of claim 1 wherein the forward extending barrel defines a barrel axis and where the latch element reciprocates along a latch axis parallel to the barrel axis.

7. The lock for a firearm of claim 6 wherein the latch element reciprocates without rotation.

8. The lock for a firearm of claim 1 wherein the locking mechanism and the latch element are operably connected by a rotating element.

9. The lock for a firearm of claim 8 wherein the rotating element is a shaft.

10. The lock for a firearm of claim 9 wherein the magazine well defines a magazine insertion axis and the shaft is aligned for rotation on a shaft rotation axis parallel to the magazine insertion axis.

11. The lock for a firearm of claim 8 wherein the latch element includes a yoke defining a transverse surface, and the locking mechanism includes a rotor having an offset pin engaging the transverse surface.

12. The lock for a firearm of claim 11 wherein the locking mechanism and latch element are interconnected by a scotch yoke.

13. The lock for a firearm of claim 1 wherein the locking mechanism includes a key insertion receptacle at a lower face of the lock body.

14. The lock for a firearm of claim 1 wherein the upper portion of the lock body extends above the barrel axis.

15. The lock for a firearm of claim 1 wherein the upper portion of the lock body extends proximate to an upper surface portion of the bolt passage.

16. The lock for a firearm of claim 1 wherein the upper portion of the lock body extends above an upper portion of the reciprocating bolt.

17. A lock for a firearm having a frame with a forward extending barrel and defining a magazine well and a bolt passage containing a reciprocating bolt movable between a rearward retracted position and a forward battery position, the lock for a firearm comprising:

a lock body configured to be closely and removably received in the magazine well;

the lock body having an upper portion configured to extend into the bolt passage when installed in the firearm, with the upper portion interposed between the reciprocating bolt and the forward extending barrel;

a locking mechanism at a lower portion of the lock body and having a locked condition and an unlocked condition;

a latch element connected at the upper portion of the lock body and interfacing the locking mechanism to move between an unlocked position when the locking mechanism is in the unlocked condition and a locked position when the locking mechanism is in the locked condition; and wherein the latch element protrudes in a forward direction from the lock body when in the locked position.

18. A lock for a firearm having a frame with a forward extending barrel and defining a magazine well and a bolt passage containing a reciprocating bolt movable between a rearward retracted position and a forward battery position, the lock for a firearm comprising:

a lock body configured to be closely and removably received in the magazine well;

the lock body having an upper portion configured to extend into the bolt passage when installed in the firearm, with the upper portion interposed between the reciprocating bolt and the forward extending barrel;

a locking mechanism at a lower portion of the lock body and having a locked condition and an unlocked condition;

a latch element connected at the upper portion of the lock body and interfacing the locking mechanism to move between an unlocked position when the locking mechanism is in the unlocked condition and a locked position when the locking mechanism is in the locked condition; and wherein the latch element extends beyond a forward limit of the magazine well when in the locked position.

* * * * *